US010158186B2

(12) United States Patent
Yang et al.

(10) Patent No.: US 10,158,186 B2
(45) Date of Patent: Dec. 18, 2018

(54) ELECTRICAL CONNECTOR HAVING CLAMPING TERMINAL

(71) Applicant: FOXCONN INTERCONNECT TECHNOLOGY LIMITED, Grand Cayman (KY)

(72) Inventors: Song Yang, Kunshan (CN); Yan-Fei Wu, Kunshan (CN); Zhi-Qiang Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 74 days.

(21) Appl. No.: 15/249,940

(22) Filed: Aug. 29, 2016

(65) Prior Publication Data

US 2017/0062965 A1 Mar. 2, 2017

(30) Foreign Application Priority Data

Aug. 28, 2015 (CN) ..... 2015 2 0658101 U

(51) Int. Cl.

| | |
|---|---|
| ***H01R 13/187*** | (2006.01) |
| ***H01R 24/58*** | (2011.01) |
| ***H01R 13/11*** | (2006.01) |
| *H01R 13/703* | (2006.01) |

(52) U.S. Cl.

CPC ..... *H01R 13/187* (2013.01); *H01R 13/11* (2013.01); *H01R 24/58* (2013.01); *H01R 13/7033* (2013.01)

(58) Field of Classification Search

CPC ..... H01R 13/187; H01R 24/58

See application file for complete search history.

(56) References Cited

U.S. PATENT DOCUMENTS

| | | | | |
|---|---|---|---|---|
| 4,585,902 A * | 4/1986 | Munroe | H01R 4/4818 174/84 S |
| 5,147,221 A * | 9/1992 | Cull | H01R 24/40 439/585 |
| 6,761,593 B2 * | 7/2004 | Hu | H01R 24/58 439/346 |
| 7,736,191 B1 * | 6/2010 | Sochor | A61N 1/3752 439/668 |

(Continued)

FOREIGN PATENT DOCUMENTS

CN 201421906 Y 3/2010

*Primary Examiner* — Briggitte R Hammond

(74) *Attorney, Agent, or Firm* — Wei Te Chung; Ming Chieh Chang

(57) ABSTRACT

An electrical connector includes an insulating housing and a clamping terminal. The insulating housing has a first side wall and a second side wall opposite to the first side wall. The insulating housing has a mating cavity opening forwardly along a front-to-back direction. The first side wall and the second side wall are disposed around the mating cavity. The clamping terminal has a main body and a resilient clamping arm extending along a transverse direction perpendicular to the front-to-back direction from the main body. The clamping arm has a contacting portion exposed in the mating cavity. The first side wall has an assembling slot, and the second side wall has a movable slot. The main body is received in the assembly slot, and a head portion of the clamping arm is movable in the movable slot.

19 Claims, 6 Drawing Sheets

(56) References Cited

U.S. PATENT DOCUMENTS

| | | | | |
|---|---|---|---|---|
| 8,070,528 | B2 * | 12/2011 | Wang | H01R 24/58 439/668 |
| 8,079,880 | B2 * | 12/2011 | Lin | H01R 13/631 439/668 |
| 8,287,314 | B1 * | 10/2012 | Gao | H01R 13/7033 439/668 |
| 8,951,071 | B2 * | 2/2015 | Tziviskos | H01R 13/15 439/668 |
| 2007/0123111 | A1 * | 5/2007 | Chien | H01R 12/58 439/668 |
| 2007/0232149 | A1 * | 10/2007 | Tai | H01R 24/58 439/668 |
| 2011/0104956 | A1 * | 5/2011 | Guo | H01R 12/57 439/668 |
| 2013/0029535 | A1 * | 1/2013 | Tian | H01R 12/716 439/668 |
| 2014/0038467 | A1 * | 2/2014 | Zhang | H01R 24/38 439/668 |
| 2015/0280371 | A1 | 10/2015 | McLaughlin et al. | |

* cited by examiner

ELECTRICAL CONNECTOR HAVING CLAMPING TERMINAL

BACKGROUND OF THE INVENTION

1. Field of the Invention

The present invention generally relates to an electrical connector, the electrical connector having a clamping terminal.

2. Description of Related Art

Chinese patent issued No. 201421906 discloses an electrical connector. The electrical connector has an insulating housing and a clamping terminal retained in the insulating housing. The insulating housing defines a mating cavity opening forwardly. The clamping terminal is assembled into the insulating housing in a rear-to-front direction. The clamping terminal has a main body and a pair of opposite clamping arms extending forwardly into the mating cavity from the main body. When the electrical connector mates with a complementary connector, the two opposite clamping terminals clamp a corresponding terminal of the complementary connector. In the patent, the electrical connector is too large due to the clamping arms' extending direction. What's more, the clamping terminal is easy to loose in frequency use due to the aforementioned assembling direction thereof.

Therefore, a miniaturization electrical connector is desired.

SUMMARY OF THE INVENTION

Accordingly, an object of the present invention is to provide an electrical connector with a small size.

In order to achieve the object set forth, an electrical connector having an insulating housing and a clamping terminal. Defining a front-to-back direction. The insulating housing has a first side wall and a second side wall opposite to the first side wall. The insulating housing has a mating cavity opening forwardly. The first side wall and the second side wall are disposed around the mating cavity. The clamping terminal has a main body and a resilient clamping arm extending in a transverse direction perpendicular to the front-to-back direction from the main body. The clamping arm has a contacting portion exposed in the mating cavity. The first side wall has an assembling slot, and the second side wall has a movable slot. The main body is received in the assembly slot, and a head portion of the clamping arm may be movable in the movable slot.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
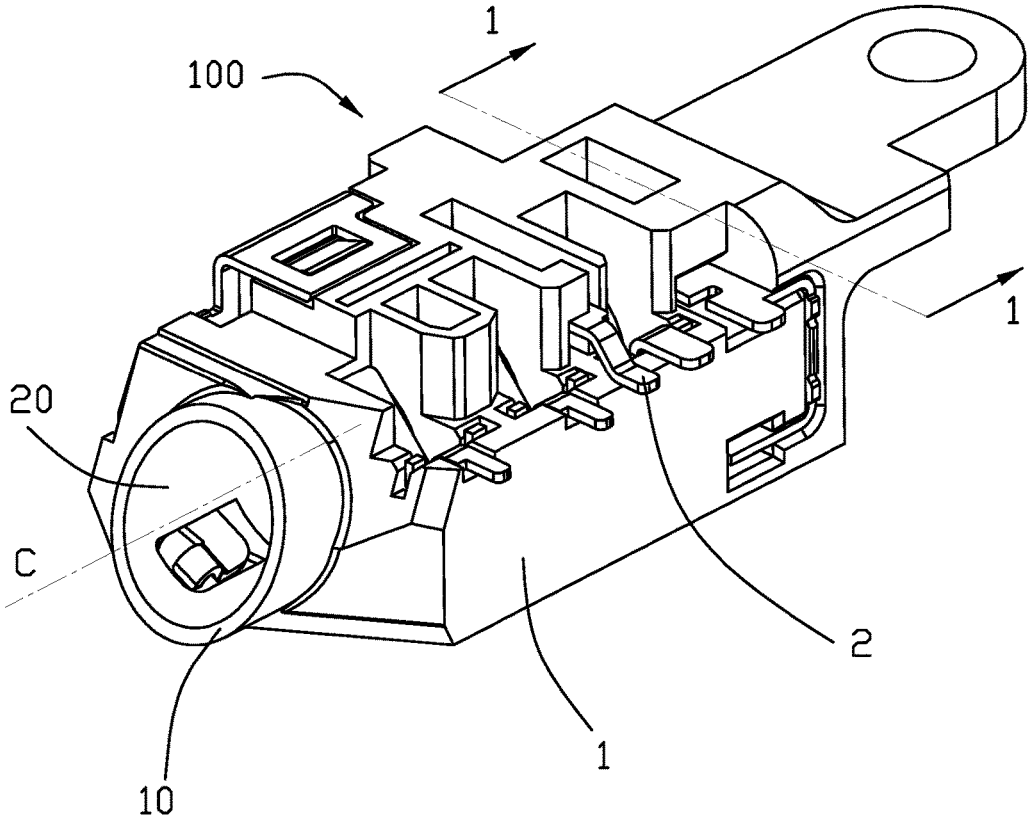
FIG. 1 is a perspective view of an electrical connector of the present invention.
Figure 2:
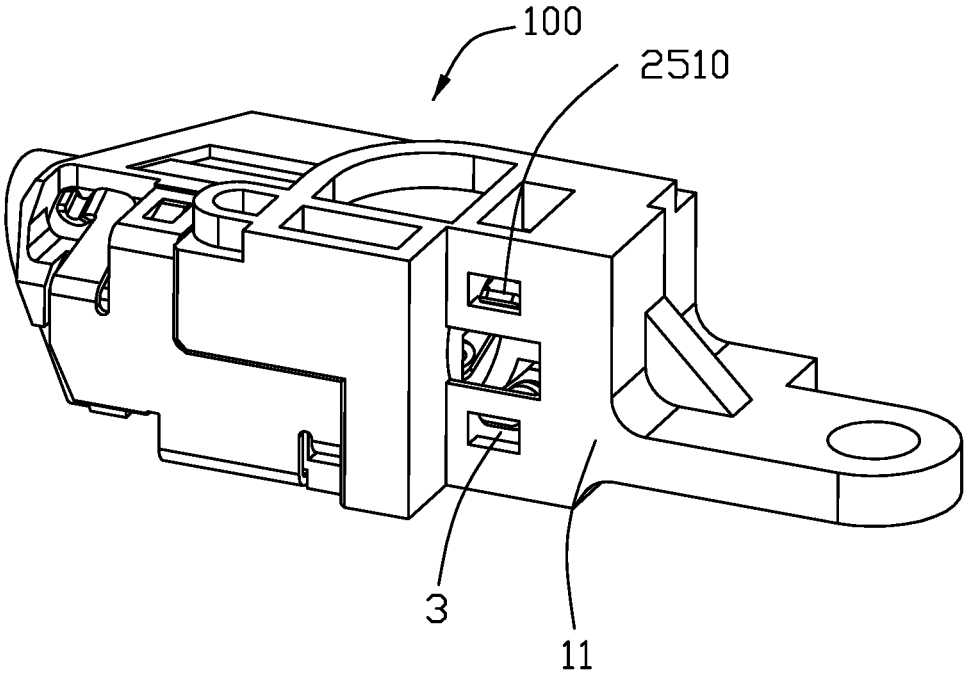
FIG. 2 is another perspective view of the electrical connector shown in FIG. 1.

Referring to FIGS. 1 to 2, the present invention is provided with an electrical connector 100. The electrical connector 100 is used for transmitting audio signal, but not limited to transmit an audio signal. The electrical connector 100 has an insulating housing 1 and a plurality of conductive terminals 2 retained in the insulating housing 1. The insulating housing 1 has a front face 10 and a mating cavity 20 going through the front face 10. The mating cavity 20 has an axis C extending along a front to back direction.

Figure 3:
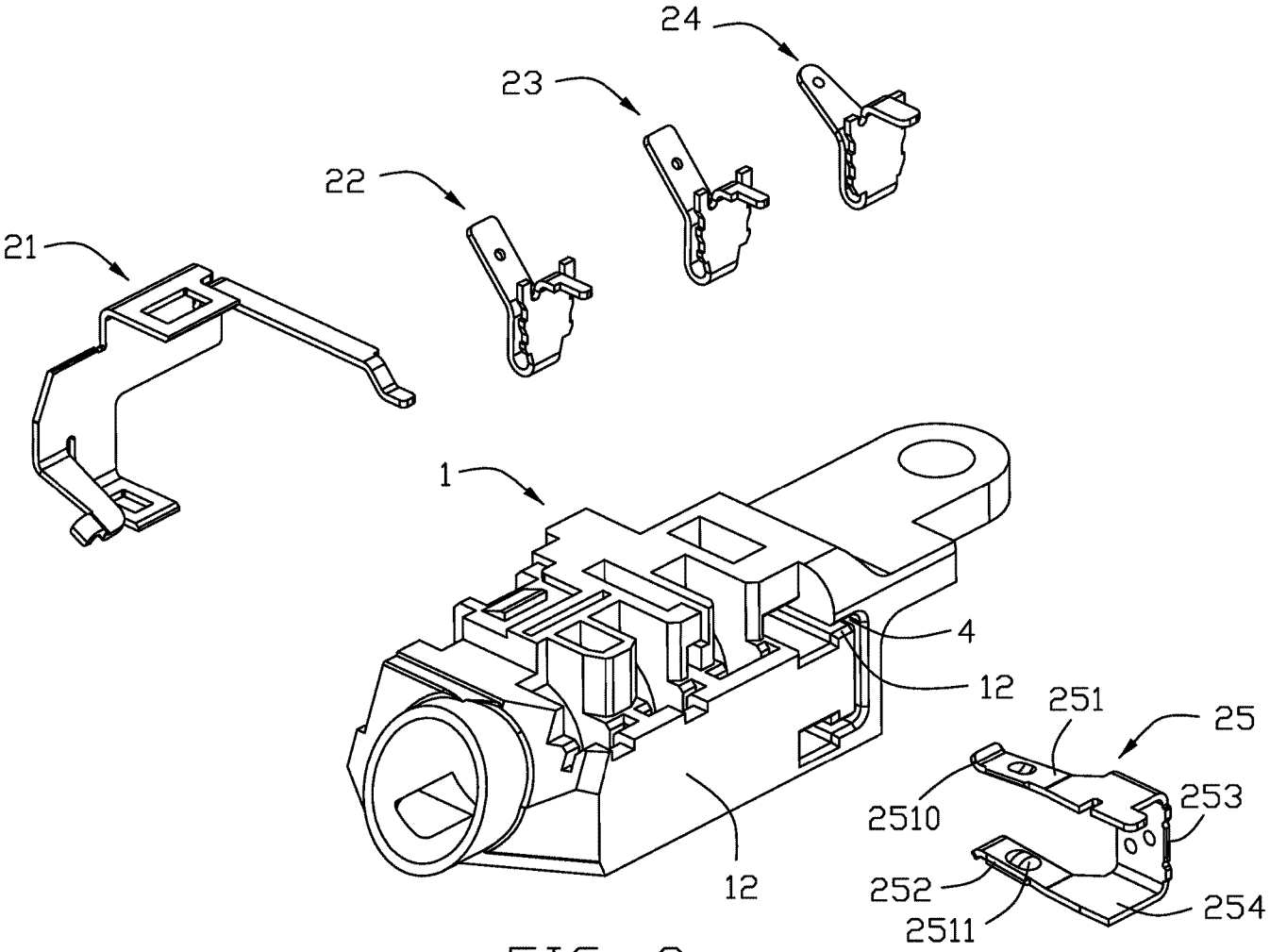
FIG. 3 is an exploded perspective view of the electrical connector shown in FIG. 1.

Referring to FIG. 3, the conductive terminals 2 have a first terminal 21, a second terminal 22, a third terminal 23, a fourth terminal 24 and a clamping terminal 25 disposed in the insulating housing 1 along the front-to-back direction. The first terminal 21 is a microphone terminal, the second terminal 22 is a grounding terminal, the third terminal 23 is a right channel terminal, the fourth terminal 24 is a left channel terminal, and the clamping terminal 25 may be functioned as clamping and detecting.

Figure 5:
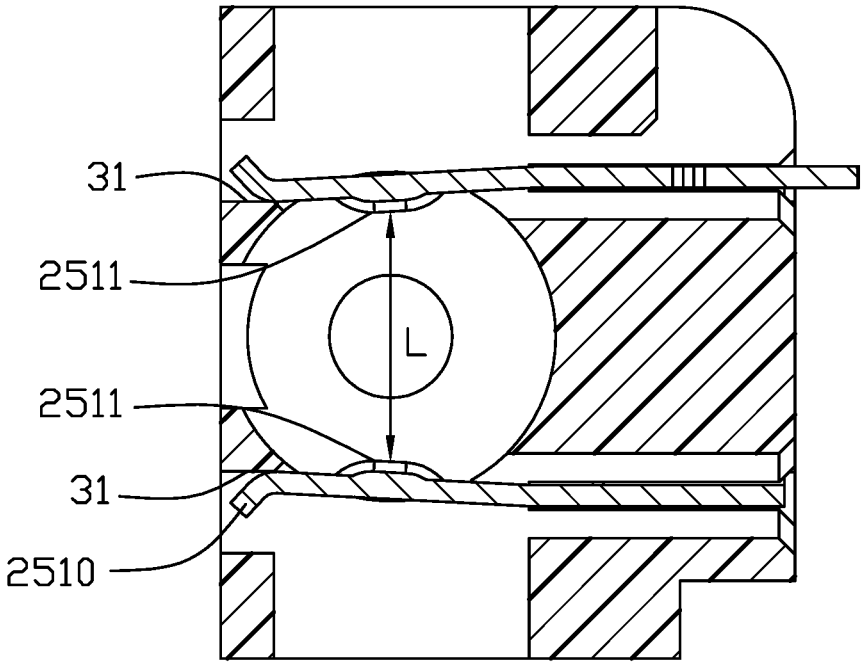
FIG. 5 is a schematic diagram when the electrical connector shown in FIG. 1 does not mate with a complementary connector, wherein two clamping arms respectively press on inner side walls of an upper movable slot and a lower movable slot.
Figure 6:
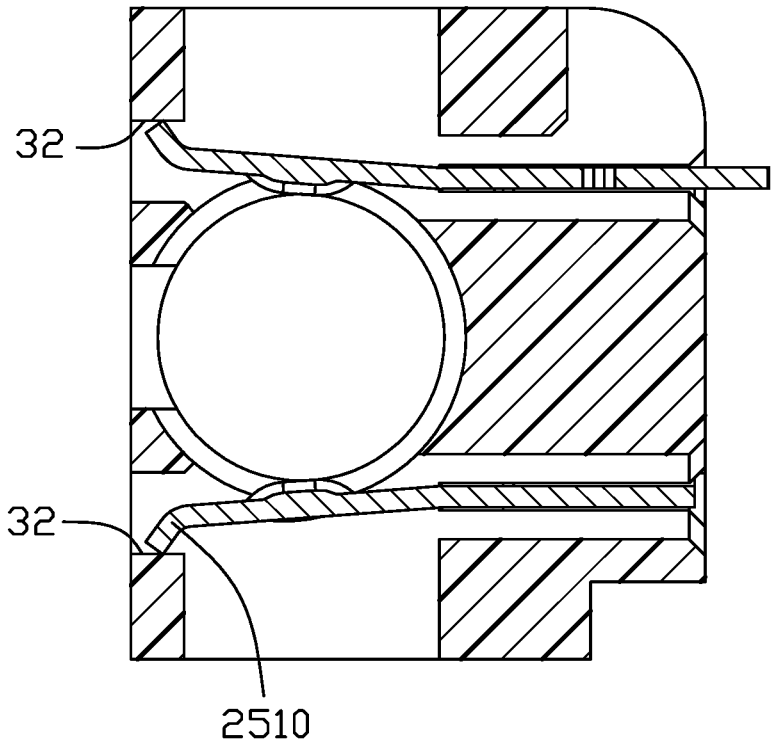
FIG. 6 is a schematic diagram when the electrical connector shown in FIG. 1 mates with a complementary connector, wherein two clamping arms respectively press on different inner side walls of the upper movable slot and the lower movable slot.

Referring to FIG. 5, the clamping terminal 25 has a pair of elastic clamping arms 251 extending into the mating cavity 20. The electrical connector 100 has two corresponding first limiting portion 31. The first limiting portions 31 outwardly press on the two corresponding clamping arms 251, thereby the clamping arms 251 are outwardly and elastically deformed relative to the axis C of the mating cavity 20 after the clamping terminal 25 is assembled and retained in the insulating housing 1. That is to say, the clamping arm 251 of the clamping terminal 25 elastically presses on the first limiting portion 31 after being assembled into the insulating housing 1. The clamping arm 251 of the clamping terminal 25 obtains a predetermined elastic force after being assembled into the insulating housing 1, thereby the electrical connector 100 does not need to provide more extra space for the deformation of the clamping terminal 25. The aforementioned specific structure of the electrical connector 100 is advantageous for the miniaturization development. In the present embodiment, the two clamping arms 251 are opposite with each other. The first limiting portions 31 respectively press on inner sides of the two clamping arms 251 to make the two clamping arms 251 deform in two opposite directions when the clamping terminal 25 is assembled and retained in the insulating housing 1, thereby the distance between the two clamping arms are essentially enlarged. It can assure the clamping force, the complementary connector can be easily inserted into the mating cavity 20. The clamping arm 251 has a head portion 2510. The first limiting portion 21 is disposed in an inner side of the head portion 2510 and outwardly presses on the head portion 2510. Each of the two clamping arms 251 defines a protruding portion 2511. The two protruding portions 2511 are exposed in the mating cavity 20 and opposite with each other. The distance L between the two opposite protruding portions 2511 is 2.5 mm after the clamping terminal 25 is assembled into the insulating housing 1, thereby the clamping terminal 25 is easy to cooperate with a terminal of the standard complementary connector. The clamping arm 251 has an inclined guiding portion 252 located in front of the protruding portion 2511, thereby the clamping terminal 25 is easy to cooperate with not only the terminal of the standard complementary connector but also a terminal of a non-standard complementary connector. Combined with FIG. 6, the electrical connector 100 has two second limiting portions 32 respectively disposed at two outer sides of the two clamping arms 251 to restrict the deformation thereof.

Figure 4:
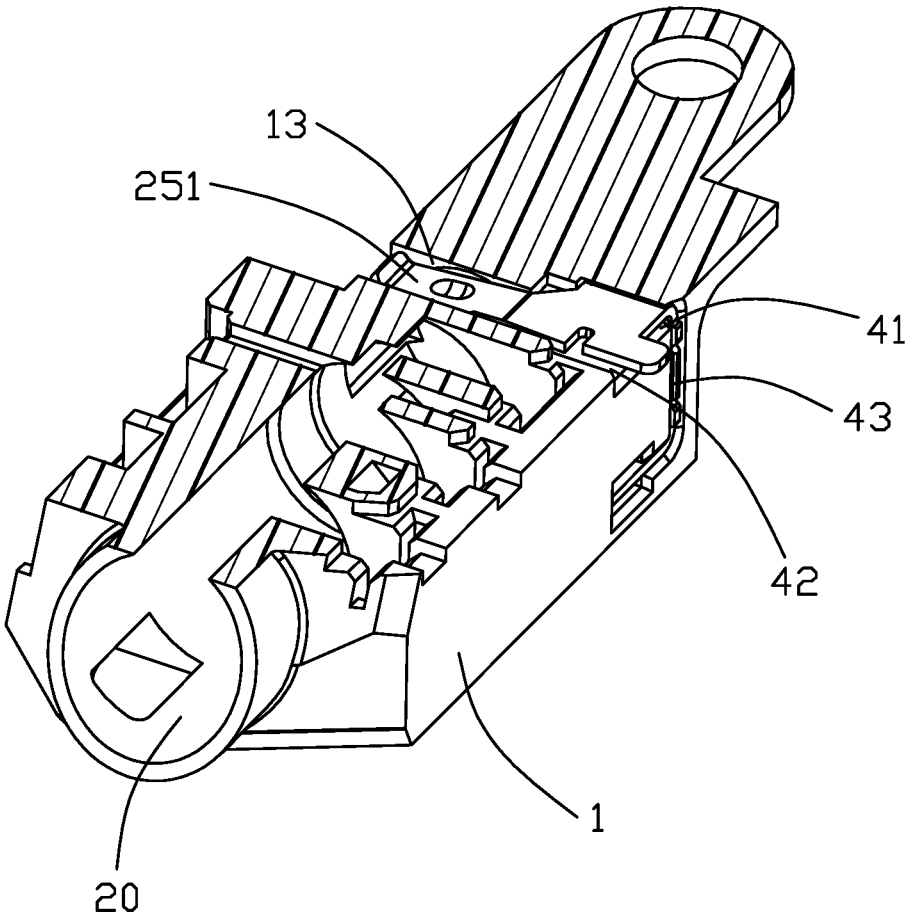
FIG. 4 is a perspective view of the electrical connector with the upper portion removed along line 1-1 shown in FIG. 1.

Referring to FIG. 2 and FIG. 3, the insulating housing 1 has a first side wall 11, a second side wall 12, an upper third side wall (not labeled) and a lower or fourth side wall (not labeled). The first side wall 11 and the second side wall 12 are opposite with each other, the third side wall and the fourth side wall are opposite with each other and respectively connecting the first side wall 11 and the second side wall 12. The first side wall 11, the second side wall 12, the third side wall and the fourth side wall are disposed around the mating cavity 20. The first side wall 11 has two movable slots 3 aligned with each other along a vertical direction perpendicular to the front-to-back direction and communicating with the mating cavity 20. The head portion 2510 of the clamping terminal 25 is assembled into the movable slot 3 after passing through the second side wall 12. That is to say, the head portions 2510 of the two clamping arms 251 respectively extend into the two corresponding movable slots 3 after the clamping terminal 25 is assembled and retained in the insulating housing 1. Each of the two movable slots 3 has an upper inner side wall and a lower inner side wall opposite to the upper inner side wall. The lower inner side wall of the upper movable slot 3 and the upper inner side wall of the lower movable slot 3 are both regarded as the first limiting portions 31. The upper inner side wall of the upper movable slot 3 and the lower inner side wall of the lower movable slot 3 are both regarded as the second limiting portions 32. The first and second limiting portions 31, 32 may be configured as protruding-type structures or hole-type structures. In the present embodiment, the insulating housing 1 defines two hole-type structures in a side wall to function as the first limiting portion 31 and the second limiting portion 32, thereby it does not need to provide extra protruding-type structures. The structure of the electrical connector 100 is simplified and the molding is correspondingly simplified, thereby it is benefit for injection molding the insulating housing 1 and reducing the total cost. Combined with FIG. 4, the insulating housing 1 defines two opposite abdicating rooms 13 communicating with the two corresponding movable slots 3 and the mating cavity 20. The two clamping arms 251 are movable in the two corresponding abdicating rooms 13 and deflectable in the vertical direction. Notably and understandably, the contacting section (not labeled) of each of the terminals extends into the mating cavity 20 for contacting the complementary connector, and in this embodiment the tails (not labeled) of all the terminals are commonly exposed upon the second side wall 12 as shown in FIG. 1. It is also understood that as shown in FIG. 3 the first terminal 21 is assembled into the housing 1 from the first side wall 11 transversely in a transverse direction, and the clamping terminal 25 is assembled into the housing from the second side wall 12 transversely in an opposite transverse direction while all the remaining second terminal 22, third terminal 23 and fourth terminal 24 are assembled into the housing 1 from the third/top side wall downwardly.

The structure of the clamping terminal 25 will be described in detail herein the after. In the present invention, the clamping terminal 25 has a U-type main body (not labeled) and the two clamping arms 251 obliquely extending from the main body along a direction perpendicular to the U-type section. The main body has a second retaining portion 253 configured as flat shape and two opposite first retaining portions 254 respectively obliquely extending from two opposite sides of the second retaining portion 253 along a same direction. The clamping arm 251 extends from an end portion of the corresponding first retaining portion 254.

The second side wall 12 defines an assembling slot 4 recessed from an outer surface thereof. The clamping terminal 25 is assembled into the insulating housing 1 after passing through the assembling slot 4. The insulating housing 1 has a block portion 12 protruding into the assembling slot 4 so as to form a first retaining slot 41 and a sliding slot 42 communicating with each other. The vertical size of the sliding slot 42 is larger than that of the first retaining slot 41. The sliding slot 42 directly communicates with the abdicating room 13. The assembling slot 4 defines a second retaining slot 43 extending in a vertical direction and communicating with the first retaining slot 41. The second retaining slot 43 is disposed behind the first retaining slot 41 and the sliding slot 42 and communicates with an exterior from the second side wall 12. When assembling the clamping terminal 25 into the insulating housing 1, the head portion 2510 passes through the sliding slot 42 and the abdicating room 13 and is received in the movable slot 3 at last. The first retaining portion 254 and the second retaining portion 253 are respectively retained in the first retaining slot 41 and the second retaining slot 43, the second retaining portion 253 entirely and rearwardly attached to an inner surface of the second retaining slot 43 after finishing the assembling process. When the electrical connector mates with a complementary connector, the clamping terminal 25 will be pushed by a force along the front-to-back direction. The second retaining portion 253 abuts against the inner surface of the second retaining slot 43 by face to face, thereby the clamping terminal 25 is not easy to loose and the insulating housing 1 is not easy to be destroyed.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulating housing having a front face and a mating cavity forwardly going through the front face along a front to back direction; and a clamping terminal retained in the insulating housing, the clamping terminal having two resilient clamping arms extending into the mating cavity;

wherein the electrical connector has two first limiting portions, each of the clamping arms elastically presses on the corresponding first limiting portion to obtain a predetermined force, the insulating housing has a first side wall defining two movable slots aligned with each other in a vertical direction perpendicular to the front to back direction and communicating with the mating cavity, each of the clamping arms has a head portion, the two head portions respectively extending into the two corresponding movable slots, each of the two movable slots having an upper inner side wall and a lower inner side wall, the lower inner side wall of the upper movable slot and the upper inner side wall of the lower movable slot formed the first limiting portions.

2. The electrical connector as claimed in claim 1, wherein the two clamping arms are opposite with each other, the two first limiting portions respectively press on inner sides of the corresponding clamping arms to make the two clamping arms elastically deform along two opposite directions.

3. The electrical connector as claimed in claim 2, wherein the first limiting portions are correspondingly disposed at inner sides of the head portions and outwardly press on the head portions.

4. The electrical connector as claimed in claim 3, further comprising having two second limiting portions disposed at outer sides of the two clamping arms to prevent the clamping arms excessively deforming, the upper inner side wall of the upper movable slot and the lower inner side wall of the lower movable slot formed the second limiting portions.

5. The electrical connector as claimed in claim 4, wherein the insulating housing has a second side wall opposite to the first side wall, the head portion of the clamping terminal being assembled into the movable slot after passing through the second side wall.

6. The electrical connector as claimed in claim 5, wherein the insulating housing has two opposite abdicating rooms communicating with the two corresponding movable slots and the mating cavity, and the two clamping arms are respectively movable in the corresponding abdicating rooms.

7. The electrical connector as claimed in claim 6, wherein the second side wall has an assembling slot recessed from an outer surface thereof, the insulating housing having a block portion protruding into the assembling slot to form a first retaining slot and a sliding slot, the vertical size of the sliding slot being larger than that of the first retaining slot, the sliding slot directly communicating with the abdicating room.

8. The electrical connector as claimed in claim 7, wherein the assembling slot has a second retaining slot disposed vertically and communicating with the first retaining slot, the second retaining slot being disposed behind the first retaining slot and the sliding slot, the second retaining slot communicating with an exterior from the second side wall, the clamping terminal having a flat second retaining portion retained in the second retaining slot, the second retaining portion entirely and rearwardly attached to an inner surface of the second retaining slot.

9. An electrical connector, comprising:

an insulating housing having a first side wall and a second side wall opposite to the first side wall, the insulating housing having a mating cavity opening forwardly along a front-to-back direction, the first side wall and the second side wall disposed around the mating cavity; and a clamping terminal having a main body and a resilient clamping arm extending from the main body along a transverse direction perpendicular to the front-to-back direction, the clamping arm having a contacting portion exposed in the mating cavity;

wherein the first side wall has an assembling slot, the second side wall has a movable slot, the main body is received in the assembly slot, a head portion of the clamping arm is movable in the movable slot.

10. The electrical connector as claimed in claim 9, wherein the assembly slot has a retaining slot to retain a retaining portion of the main body, a free end of the head portion is received and movable in the movable slot.

11. The electrical connector as claimed in claim 9, wherein the movable slot works on a free end of the head portion to restrict the head portion to move outwardly when the clamping terminal cooperates with a terminal of a complementary connector so as to enhance the clamping force.

12. The electrical connector as claimed in claim 9, wherein the mating cavity has an axis, and the movable slot presses on the head portion to make the clamping arm move outwardly relative to the axis to form a predetermined elastic force.

13. The electrical connector as claimed in claim 9, wherein the movable slot has a continues inner surface surrounding the head portion.

14. The electrical connector as claimed in claim 9, wherein the movable slot outwardly goes through an outer surface of the second side wall.

15. An electrical connector comprising an insulating housing having a front face and a mating cavity forwardly going through the front face along a front-to-back direction, said housing unitarily forming a first limiting portion; and a clamping terminal configured to be assembled to the housing in a transverse direction perpendicular to said front-to-back direction with a resilient clamping arm extending into the mating cavity and deflectable in a vertical direction perpendicular to both said front-to-back direction and said transverse direction; wherein the clamping terminal is configured to be mated with a complementary connector entering the mating cavity from the front face in said front-to-back direction, and the clamping arm elastically presses on the first limiting portion to obtain a predetermined force thereof before mating with the complementary connector; and further including a first terminal, a second terminal, a third terminal and a fourth terminal, wherein all the second terminal, the third terminal and the fourth terminals are configured to be assembled into the housing downwardly in the vertical direction from a top side wall, and the first terminal is assembled into the housing from a first side wall in a transverse direction while the clamping terminal is assembled into the housing from a second side wall opposite to said first side wall in an opposite transverse direction.

16. The electrical connector as claimed in claim 15, wherein tails of all said first terminal, said second terminal, said third terminal, said fourth terminal and said clamping terminals are commonly exposed on one of said first side wall and said second side wall.

17. The electrical connector as claimed in claim 15, wherein said first limiting portion is formed around a moveable slot which is formed in the first side wall of the housing and exposed to an exterior in said opposite transverse direction.

18. The electrical connector as claimed in claim 15, wherein said first limiting portion is formed around a moveable slot which is formed in the housing and exposed to an exterior in the transverse direction.

19. The electrical connector as claimed in claim 18, wherein said housing further unitarily forms a second limiting portion formed around said moveable slot opposite to said first limiting portion for preventing excessive deformation of the clamping terminal after the complementary connector is inserted into the mating cavity.

* * * * *